US006622681B2

(12) United States Patent
Trumpf et al.

(10) Patent No.: US 6,622,681 B2
(45) Date of Patent: Sep. 23, 2003

(54) CONNECTOR BETWEEN A CARBURETOR AND A CYLINDER OF AN INTERNAL COMBUSTION ENGINE

(75) Inventors: Johann Trumpf, Winnenden (DE); Michael Raffenberg, Fellbach (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 10/078,800

(22) Filed: Feb. 19, 2002

(65) Prior Publication Data

US 2002/0117137 A1 Aug. 29, 2002

(30) Foreign Application Priority Data

Feb. 26, 2001 (DE) ..... 101 09 207

(51) Int. Cl.[7] ..... F02M 35/10
(52) U.S. Cl. ..... 123/184.21
(58) Field of Search ..... 123/184.21, 184.46, 123/184.61, 73 PP, 73 A, 73 R, 590, 591, 593

(56) References Cited

U.S. PATENT DOCUMENTS 4,711,225 A * 12/1987 Holderle et al. ..... 123/590
4,712,523 A * 12/1987 Matsubayashi ..... 123/188.14

FOREIGN PATENT DOCUMENTS

DE 36 17 759 A1 12/1986

* cited by examiner

*Primary Examiner*—Henry C. Yuen
*Assistant Examiner*—Hyder Ali
(74) *Attorney, Agent, or Firm*—R W Becker & Associates; R W Becker

(57) ABSTRACT

A connector between a carburetor and a cylinder connection of an internal combustion engine of an implement is provided. The flow channel formed in the connector is provided with raised portions over the inner periphery of the channel. To avoid fluctuations in the speed of the engine as a function of changes in position of the implement, the raised portions are embodied as wall portions that are oriented approximately transverse to the center line of the channel. The wall portions provide a flow cross-section for the channel that varies in a step-shape or terrace-shaped manner.

14 Claims, 4 Drawing Sheets

CONNECTOR BETWEEN A CARBURETOR AND A CYLINDER OF AN INTERNAL COMBUSTION ENGINE

BACKGROUND OF THE INVENTION

The present invention relates to a connector between a carburetor and a cylinder connection of an internal combustion engine, especially a two-stroke engine of an implement, such as a power chain saw, a brush cutter, a trimmer, or the like.

Connectors of this type conduct the fuel/air mixture produced in the carburetor to the combustion chamber of the cylinder, either directly or via the crank chamber. In so doing, a portion of the fuel is deposited on the inner wall of the connector. The fuel film that is thereby formed on the inner wall is drawn in in an uncontrolled manner, which can lead to fluctuations in speed. Especially when the engine drops down to idling after a full load phase (rich come down), there repeatedly occurs the phenomenon that the engine sticks at a higher speed and assumes a significantly higher idling speed. This is attributable to an uncontrolled supply of fuel. In particular, if after a full load phase the butterfly valve is again closed (idling position), a higher underpressure builds up in the connector that carries along the deposited residual fuel and thus prevents an orderly dropping down to the set low idling speed. This is frequently detected especially with small engines.

A connector is known from DE 36 17 759 A1 that has a structured inner wall. In this connection, the structure is formed by quadrilateral annular raised portions transverse to the axial direction of the connector. The annular raised portions are interrupted by longitudinal grooves. As a consequence of these longitudinal grooves, deposited quantities of fuel are to be conveyed to the internal combustion engine in as close to real time as possible in order to keep the residual quantity of fuel as low as possible. However, the problem of the "rich come down" effect cannot be eliminated with this configuration.

It is therefore an object of the present invention to improve a connector between the carburetor and the cylinder connection of an internal combustion engine in such a way that it is guaranteed that the internal combustion engine can drop down to the set idling speed in a manner free of disruption.

BRIEF DESCRIPTION OF THE DRAWING

This object, and other objects and advantages of the present invention, will appear more clearly from the following specification in conjunction with the accompanying schematic drawings, in which.

SUMMARY OF THE INVENTION

Figure 1:
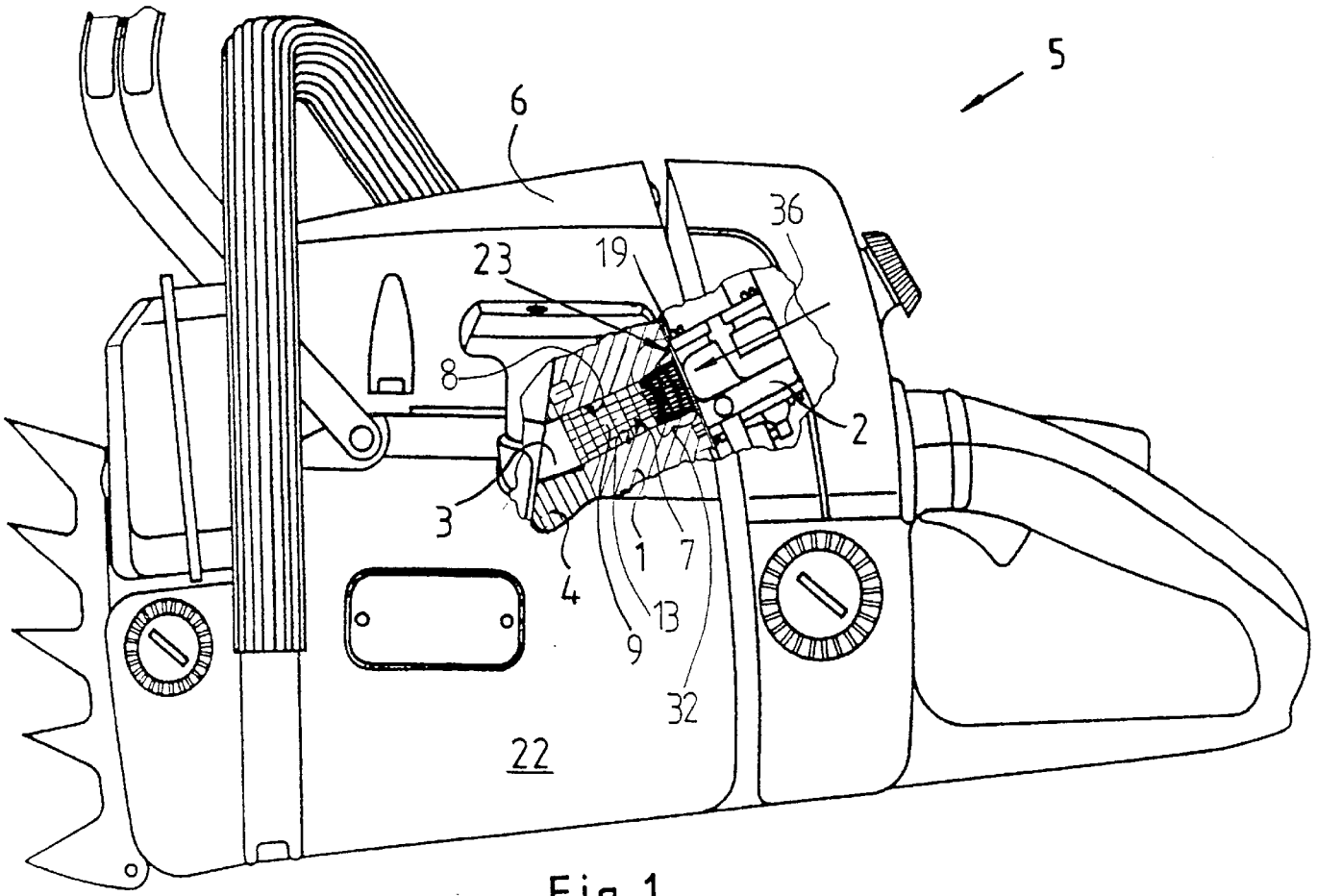
FIG. 1 is a partially cross-sectioned view of a power chain saw having one exemplary embodiment of an inventive connector.

The connector of the present invention comprises raised portions provided on the inner periphery of the channel of the connector, wherein such raised portions are embodied as wall portions of the inner periphery of the channel that are oriented approximately transverse to the longitudinal center line of the channel, and wherein the raised portions provide a step-shaped or terrace-shaped flow cross section for the channel.

By arranging raised portions in this inventive manner, first of all a flow of fuel along the inner wall of the channel is impeded. The fuel is effectively held back. The fuel portions are retained in many small divided quantities on the plurality of step-like wall portions and by the terracing that is formed on the inner wall of the channel. As a result, the adhesion or capillary forces are usable, so that even at greater underpressures, a drawing-in of the small and very small-retained fuel quantities is prevented. An escaping or flowing-off to the engine is prevented even under "rich come down" conditions. The engine drops down to idle in a manner free of disruption. During a further full load phase, further fuel is deposited, so that the individual quantities become greater and are dislodged. In so doing, they are pulled away at the edges in small drops and are mixed with the intake air stream as fine fuel particles. Under partial and full load, these admixed quantities are without significance not only for the output of the engine but also for the constancy of the speed.

The step-like wall portions are disposed over the entire periphery of the inner wall of the channel, so that even if the operating position of the implement is changed, the inventive retention effect is provided. Preferably a plurality of terrace-shaped wall portions having an extent that remains uniform over the axial length of the channel are provided, as a result of which the cross-section of the channel is reduced in an inward direction. In this connection, that wall portion that faces the channel center line is provided between two steps with a mold-release angle of at the most 1°, preferably 0.5°. With such a mold-release angle, a plurality of steps are to be formed over the respective axial extent of the channel, with such steps then in their totality leading to the desired high retention effect. It is possible for the first time in this manner to produce the connector from incompressible material, such as duroplastic material. From both sides of the channel that is to be produced, monolithically formed coring tools having an appropriate shape are introduced to produce the connector, and after the casting or injection molding of the connector are withdrawn.

The cross-section of the channel in the connector can have many different shapes. It is expedient to provide the channel, on the cylinder side, with an oval cross-section, and on the carburetor side with a circular cross-section, whereby the cross-sections merge with one another in the interior of the connector.

To increase the retention effect, it is expedient to dispose prismatically shaped raised portions on the terrace or step surfaces of the wall portions that face the channel center line, with such raised portions preferably being formed monolithically with the surfaces. The prismatic raised portions form an additional fissuring or crevasse formation on the inner wall of the channel, and hence form a greater resistance for a fuel film that is deposited on the wall. Preferably, the wall portions on the carburetor side are provided with such prismatic raised portions.

The inventive configuration of the connector enables production thereof from incompressible or non-elastic material, since appropriate mold release angles are maintained and undercuts are avoided. Nonetheless, the inventive connector could also be formed of elastomeric material.

Further specific features of the present invention will be described in detail subsequently.

DESCRIPTION OF PREFERRED EMBODIMENTS

Referring now to the drawings in detail, FIG. 1 schematically shows a partially longitudinal cross-sectioned implement 5, namely in the illustrated embodiment a power chain saw 6, which is driven by an internal combustion engine 4, especially a two-stroke or a four-stroke engine. By means of a non-illustrated centrifugal clutch, the internal combustion engine 4 drives a tool, for example a saw chain that circulates on a guide bar. The internal combustion engine 4 is disposed in a housing 22, and a carburetor 2 is flanged onto an intake connection 3 of the cylinder. The carburetor 2, accompanied by the spanning of a movement gap, is securely mounted on the intake or cylinder connection 3 via a connector 1. By means of the connector 1, the fuel/air mixture produced in the carburetor 2 is supplied to the combustion chamber of the internal combustion engine 4 via an intake channel 9 formed in the connector 1.

Figure 2:
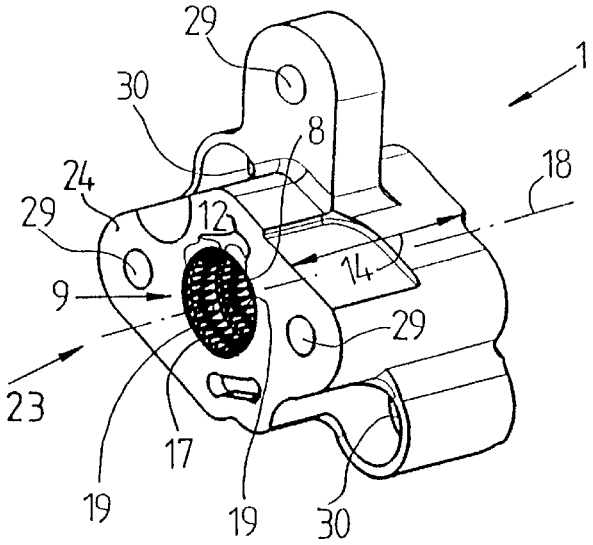
FIG. 2 is a schematic view of the connector illustrated in FIG. 1.
Figure 3:
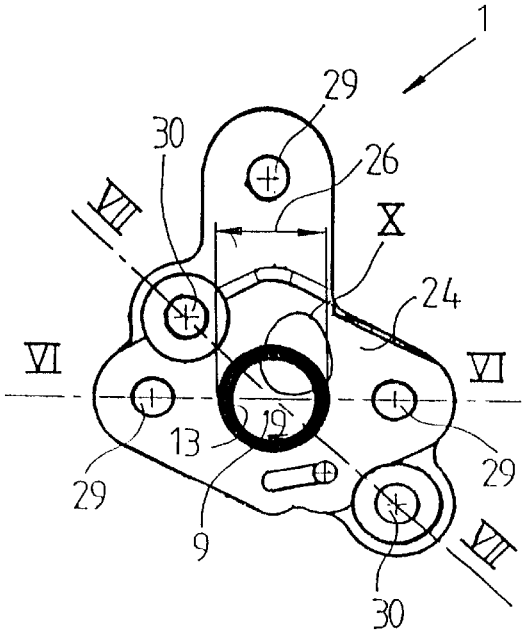
FIG. 3 is a view of the carburetor side of the connector of FIG. 2.
Figure 4:
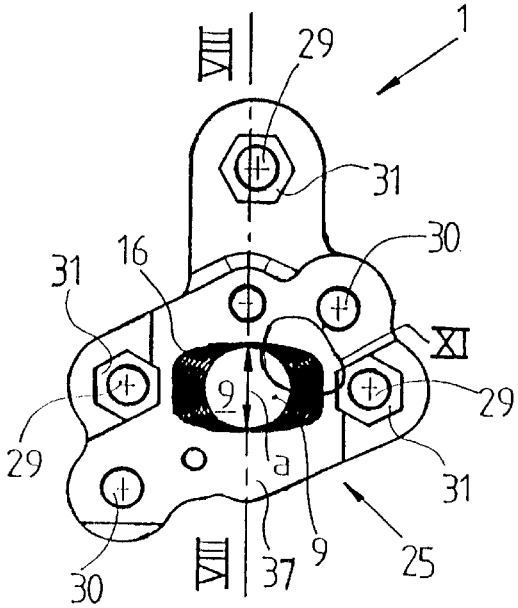
FIG. 4 is a view of that side of the connector of FIG. 2 that faces the cylinder.
Figure 5:
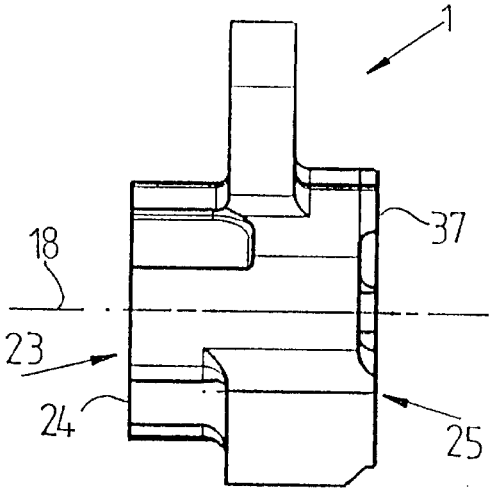
FIG. 5 is a side view of the connector of FIG. 2.
Figure 8:
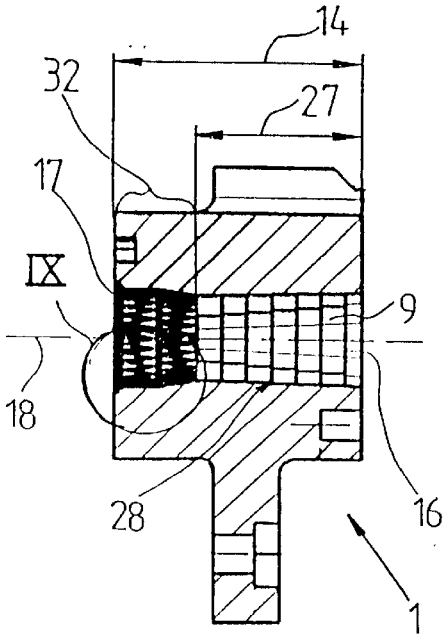
FIG. 8 is a longitudinal cross-sectional view taken through the connector along the line VIII—VIII in FIG. 4.

As shown in FIGS. 2 and 3, the connector 1, on its carburetor side 23, has a circular or round channel cross-section 17 and a flange surface 24 via which the connector rests sealingly against the end face of the carburetor 2. In this connection, the inner wall 13 of the channel 9 merges in a flush manner with the inner wall of the channel section in the carburetor. The channel 9 tapers in an advantageous manner from the carburetor side 23 while maintaining its circular or round cross-section over approximately a third of the axial length 14 of the intake channel 9. As shown in FIG. 4, the connector 1, on its cylinder side 25, has an oval channel cross-section 16. FIG. 5 clarifies that the carburetor side 23 and the cylinder side 25 of the connector 1 form flange surfaces 24,37 that are parallel to one another. In this connection, as shown in FIGS. 4 and 8, the small semi-axis "a" of the channel cross-section 16 has approximately the magnitude of the maximum diameter 26 of the circular cross-section 17 in the flange surface 24 of the connector 1. The channel 9 tapers from the cylinder side 25, accompanied by a change of its cross-sectional shape from oval to circular or round over an axial length 27, which corresponds approximately to two thirds of the axial length 14 of the channel 9, and merges in the connector 1 into the circular or round cross-section of the channel portion provided on the carburetor side.

Figure 6:
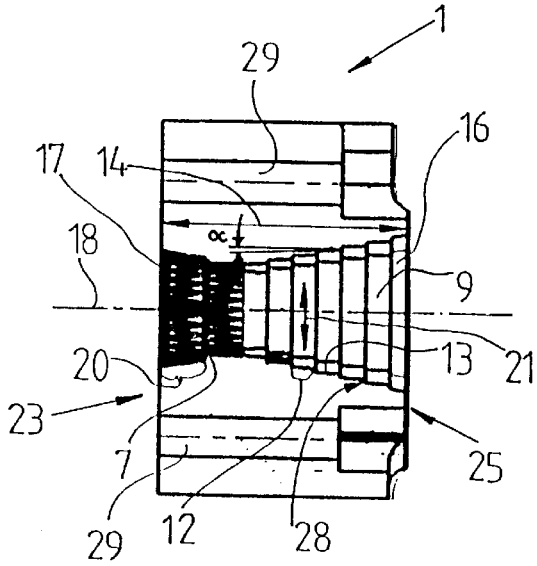
FIG. 6 is a longitudinal cross-sectional view taken from the line VI—VI in FIG. 3.
Figure 7:
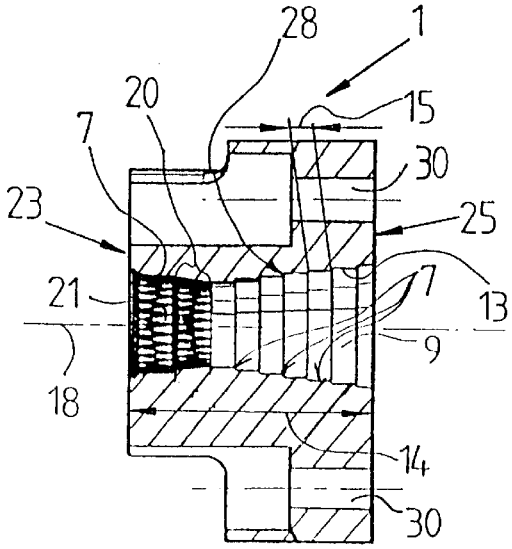
FIG. 7 is a longitudinal cross-sectional view taken through the connector along the line VII—VII in FIG. 3.

As shown in FIGS. 6 and 7, elevations or raised portions 7, preferably differently shaped raised portions, are formed on the inner periphery 8 (see FIG. 9) of the channel 9 over the entire axial length 14 thereof. In the illustrated embodiment, the raised portions 7 are disposed over the entire inner wall 13 of the channel 9. It can also be expedient to provide the raised portions 7 over only partial surfaces of the inner wall 13 of the channel 9. In the illustrated embodiment, the raised portions 7 are formed as step-shaped or terrace-shaped wall portions 12 that vary the longitudinal cross-section 11 of the channel 9. The wall portions 12 extend approximately parallel to the center line 18 of the channel 9. In this way, in the illustrated embodiment seven wall portions 12 are provided over the axial partial length 27 of the channel 9. As viewed from the cylinder side 25, the wall portions 12 narrow the cross-section of the channel 9 in a step-like manner. In this connection, all of the wall portions 12 have approximately the same axial extent 15, so that the step surfaces 21 have approximately the same width. The raised portions 7 are formed by the surfaces 21 and by step edges 28 that are disposed approximately perpendicular to the surfaces 21.

Figure 11:
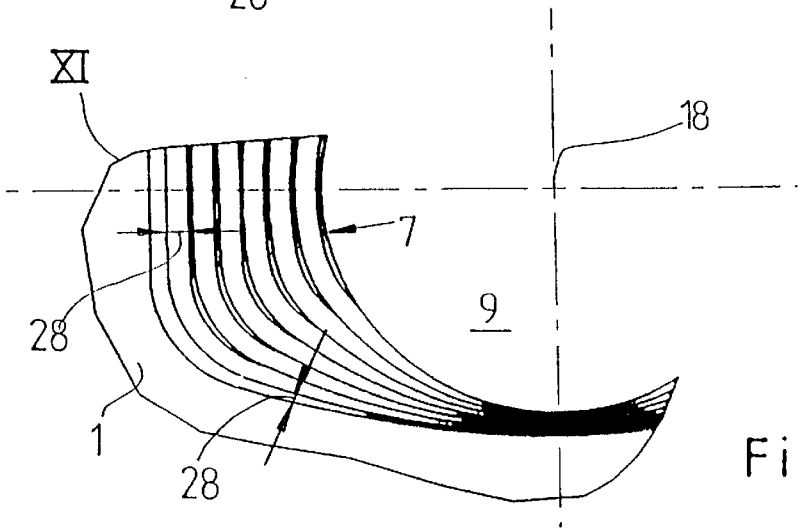
FIG. 11 shows the portion XI in FIG. 4.

FIGS. 6 and 8 show longitudinal cross-sections that respectively extend through the connector 1 at right angles to one another. FIG. 11 shows a partial view of the channel 9 from the cylinder side 25. The step edges 28, as viewed in the direction of the center line 18 of the channel 9 of the connector 1, are shorter than the step edges transverse to the center line of the channel. Due to the transition of the oval cross-section 16 of the channel 9 into the circular or round cross-section 17 of the carburetor side of the channel 9, the heights of a step edge 28 of a raised portion 7 are compensated for over the entire periphery of the channel 9.

In the schematic view of the connector 1 from its carburetor side 23 (FIG. 2), through-bores 29 and 30 are provided that extend parallel to the center line 18 of the channel and that are provided on the cylinder side end with insertion nuts 31 (see FIG. 4). The through-bores 29 and the insertion nuts 31 serve for receiving connecting elements for fixing the carburetor in position on the connector 1. Two through-bores 30, which are disposed diametrically opposite one another relative to the channel center line 18, and which extend in the longitudinal direction of the channel 9, serve for receiving connecting means for fixing the connector 1 in position on the cylinder.

In the view of the connector 1 shown in FIG. 2, partially shown are two wall portions 12 of the channel 9 having the circular cross-section. Disposed upon those surfaces of the wall portions 12 that are directed toward the center line 18 of the channel are prismatically formed raised portions 19, which are preferably integrally or monolithically connected with the surfaces 21.

Figure 9:
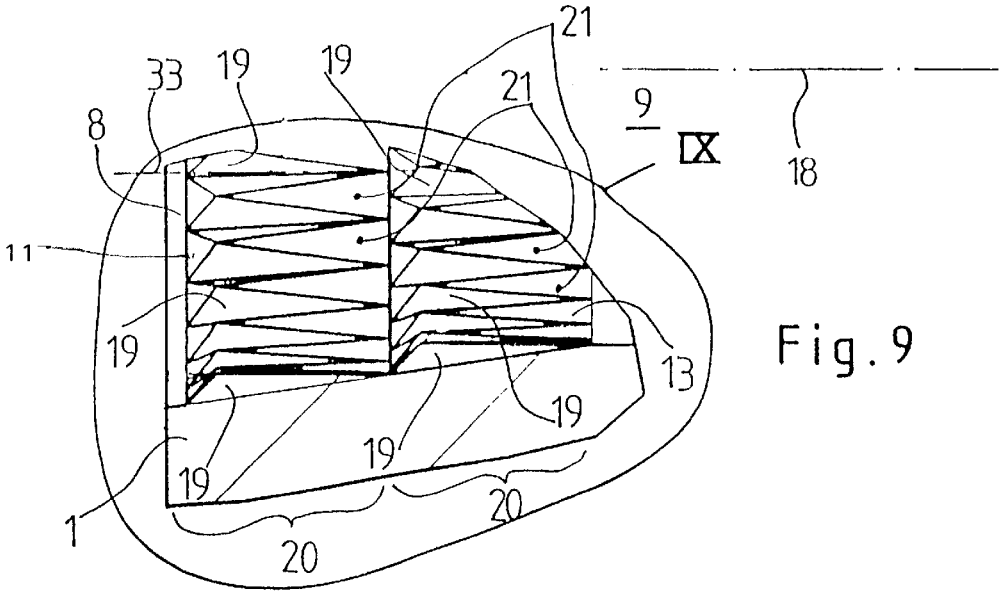
FIG. 9 shows the encircled portion IX of FIG. 8.
Figure 10:
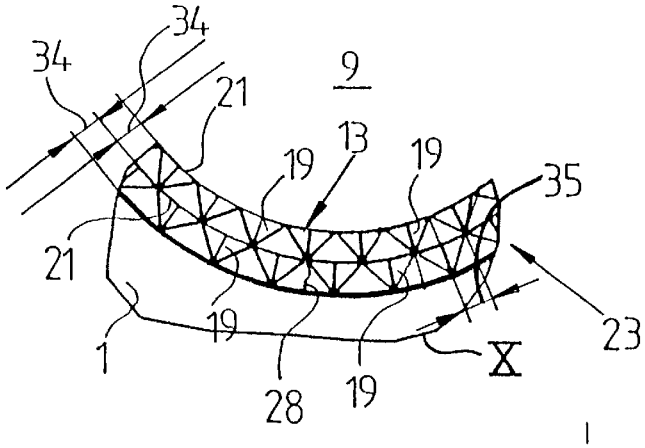
FIG. 10 shows the portion X in FIG. 3.

FIG. 9 in particular shows a section of the pertaining wall portions. In contour, the prismatic raised portions 19 have an elongated triangular form and are disposed, preferably uniformly distributed, over the entire periphery 8 of the corresponding wall portion 20 and adjoin one another. In this connection, the longitudinal axes 33 of the prismatic raised portions 19 are oriented in the direction of the channel center line 18. As best shown in FIG. 10, the prismatic raised portions 19 have a maximum height 34 that preferably corresponds to the height of the step edge 28 of the wall portions 12 in the carburetor side channel portion 32. The end view of the carburetor side 23 of the connector 1 illustrated in FIG. 10 additionally shows that the prismatic raised portions 19 of the two wall portions 12 have a transverse offset 35 relative to one another that expediently corresponds to half of the maximum width of the prismatic raised portions 19. By disposing the prismatic raised portions 19 in the carburetor side portion 32 of the channel 9, an advantageous strong fissuring or crevasse formation of the inner wall 13 is provided in one region of the channel 9.

During operation of the internal combustion engine 24, the fuel/air mixture formed in the carburetor 2 flows in the direction of the arrow 36 (FIG. 1) through the channel 9 to the combustion chamber of the internal combustion engine 4. In so doing, portions of the fuel, in liquid form, are deposited on the inner wall 13 of the channel 9, and in particular on the inner wall of the channel portion 32. Due to the pronounced fissuring and the terrace steps, the fuel is divided into small and very small quantities of fuel that, in part utilizing the capillary association forces, cannot readily be carried along, even at high underpressures. An uncontrolled fuel feed is prevented under rich come down conditions. The engine drops from full load to idle in a manner free of disruption. Especially due to the lateral offset of the prismatic raised portions 19, a direct flow of the fuel film from the carburetor 2 to the internal combustion engine 4 along the inner wall 13 is prevented. Also during idling itself, a quieter and smoother running of the internal combustion engine is achieved. Due to the fact that the raised portions 7 are disposed in the described manner over the entire inner periphery 8 of the inner wall 13 of the channel 9, a release of an undesired quantity of liquid fuel is additionally effectively prevented during pivoting of the implement; an over rich mixture is avoided.

As a consequence of the illustrated configuration of the prismatic raised portions 19 in the form of an acute angled, tapering, roof-shaped structure, a conicity of the channel portion 32 toward the carburetor side 23 of the connector 1 is provided. Especially if the connector is made of incompressible material, for example duroplastic, or thermosetting, material (polymeric material), after the manufacture of the connector the removal of a core-forming tool is readily possible. In this connection, the surface that faces the channel center line is provided at a mold-release angle of approximately $0<\alpha\leqq 1°$, so that even where the channels are short, a pronounced terracing effect is provided accompanied by a high retention capacity. An advantageous mold-release angle a is in the order of magnitude of 0.5°.

The present invention is provided, in particular, for two-stroke engines, since with such an engine the effect of the speed fluctuation can be particularly great due to the low flywheel mass and due to the greatly pulsating pressure fluctuations between the carburetor and the engine.

The specification incorporates by reference the disclosure of German priority document 101 09 207.5 filed Feb. 26, 2001.

The present invention is, of course, in no way restricted to the specific disclosure of the specification and drawings, but also encompasses any modifications within the scope of the appended claims.

We claim:

1. A connector between a carburetor and a cylinder connection of an internal combustion engine of an implement, wherein a channel is formed in said connector for establishing communication between the carburetor and the cylinder connection, said connector comprising:

raised portions provided on an inner periphery of said channel, wherein said raised portions are embodied as wall portions of said inner periphery of said channel that are oriented approximately transverse to a longitudinal center line of said channel, and wherein said wall portions provide an approximately step-shaped or terrace-shaped flow cross-section for said channel, and wherein said cross-section varies over a longitudinal extent of said channel.

2. A connector according to claim 1, wherein said wall portions extend over the entire periphery of an inner wall of said channel.

3. A connector according to claim 1, wherein said wall portions have an approximately uniform axial extent over an axial length of said channel.

4. A connector according to claim 1, wherein surfaces of said wall portions that face said center line of said channel are disposed at a mold-release angle of approximately up to 1°, relative to said channel center line.

5. A connector according to claim 1, wherein a portion of said channel on a cylinder side has an approximately oval cross-section.

6. A connector according to claim 5, wherein a portion of said channel on a carburetor side has a circular cross-section.

7. A connector according to claim 1, wherein prismatic raised portions are disposed on surfaces of said wall portions that are oriented toward said center line of said channel.

8. A connector according to claim 7, wherein said prismatic raised portions are monolithically formed with said surfaces of said wall portions.

9. A connector according to claim 7, wherein said prismatic raised portions are disposed on wall portions that are disposed on a carburetor side of said channel.

10. A connector according to claim 1, which is made primarily of incompressible material.

11. A connector according to claim 10, wherein said material is a thermo setting polymeric material.

12. A connector according to claim 4, wherein said mold-release angle is 0.5°.

13. A connector according to claim 1, wherein starting from a carburetor side, said channel is tapered while maintaining a circular or round cross-section over approximately one-third of an axial length of said channel.

14. A connector according to claim 1, wherein starting from a cylinder side, said channel is tapered accompanied by a change in its cross-section from oval to circular or round over approximately two-thirds of an axial length of said channel.

* * * * *